US005431451A

United States Patent [19]

Bork et al.

[11] Patent Number: 5,431,451

[45] Date of Patent: Jul. 11, 1995

[54] REUSABLE FACSIMILE SHEET FOR FACSIMILE MACHINE

[76] Inventors: Linda Bork; Kirk Green, both of P. O. Box 1305, Brunswick, Me. 04011; George Spector, 233 Broadway Room 702, New York, N.Y. 10279

[21] Appl. No.: 125,257

[22] Filed: Sep. 23, 1993

[51] Int. Cl.[6] ..... B42D 15/00

[52] U.S. Cl. ..... 283/94; 283/67; 358/400; 206/229; 206/233

[58] Field of Search ..... 283/91, 94, 902, 67; 358/400; 206/229, 233, 224, 494; 15/244.3, 244.1, 104.93, 104.94

[56] References Cited

U.S. PATENT DOCUMENTS

| | | | |
|---|---|---|---|
| 2,522,909 | 9/1950 | Wadanoli | 206/233 X |
| 2,692,673 | 10/1954 | Kruft | 206/233 |
| 3,299,464 | 1/1967 | O'Brien et al. | 206/229 X |
| 4,015,306 | 4/1977 | Fenster | 15/244.3 X |
| 5,024,332 | 6/1991 | Stackler | 283/81 X |
| 5,109,287 | 4/1992 | Clark | 358/403 |
| 5,111,934 | 5/1992 | Morin | 15/104.94 X |
| 5,126,137 | 6/1992 | Lambert | 15/244.3 X |
| 5,126,858 | 6/1992 | Kurogane et al. | 358/453 X |
| 5,178,420 | 1/1993 | Shelby | 283/94 |

FOREIGN PATENT DOCUMENTS

| | | | |
|---|---|---|---|
| 469644 | 8/1914 | France | 15/244.3 |
| 11063 | 1/1916 | United Kingdom | 15/244.3 |
| 1100988 | 1/1968 | United Kingdom | 15/104.93 |
| 2061709 | 5/1981 | United Kingdom | 15/104.93 |
| 9003277 | 4/1990 | WIPO | 283/94 |
| 92/05035 | 4/1992 | WIPO | 283/67 |

*Primary Examiner*—Frances Han

*Attorney, Agent, or Firm*—Frederick R. Cantor

[57] ABSTRACT

A reusable facsimile cover letter is provided, which consists of a paper sheet printed with indicia and blank lines on both sides. A layer of heat sealed clear plastic laminate is on both sides of the paper sheet. Data can be written on the clear plastic laminate, then erased and replaced with new data. A marking pen is for writing the data, while an eraser being a cloth encased sponge is for erasing the data. A container and holder can also be provided for the eraser and marker pen.

1 Claim, 1 Drawing Sheet

REUSABLE FACSIMILE SHEET FOR FACSIMILE MACHINE

BACKGROUND OF THE INVENTION

The instant invention relates generally to business forms and more specifically it relates to a reusable facsimile cover letter, which provides a cover letter that is writable and erasable, so that it can be used over and over again.

There are available various conventional business forms which do not provide the novel improvements of the invention herein disclosed.

SUMMARY OF THE INVENTION

A primary object of the present invention is to provide a reusable facsimile cover letter that will overcome the shortcomings of the prior art devices.

Another object is to provide a reusable facsimile cover letter, wherein the cover letter is printed on both sides and then heat sealed laminated on both sides, and wherein the cover letter can be written on and then erased, so that it can be used over and over again saving wasted letter material.

An additional object is to provide a reusable facsimile cover letter that comes with a marking pen to place information on the cover letter and an eraser for removing the information from the cover letter.

A further object is to provide a reusable facsimile cover letter that is simple and easy to use.

A still further object is to provide a reusable facsimile cover letter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
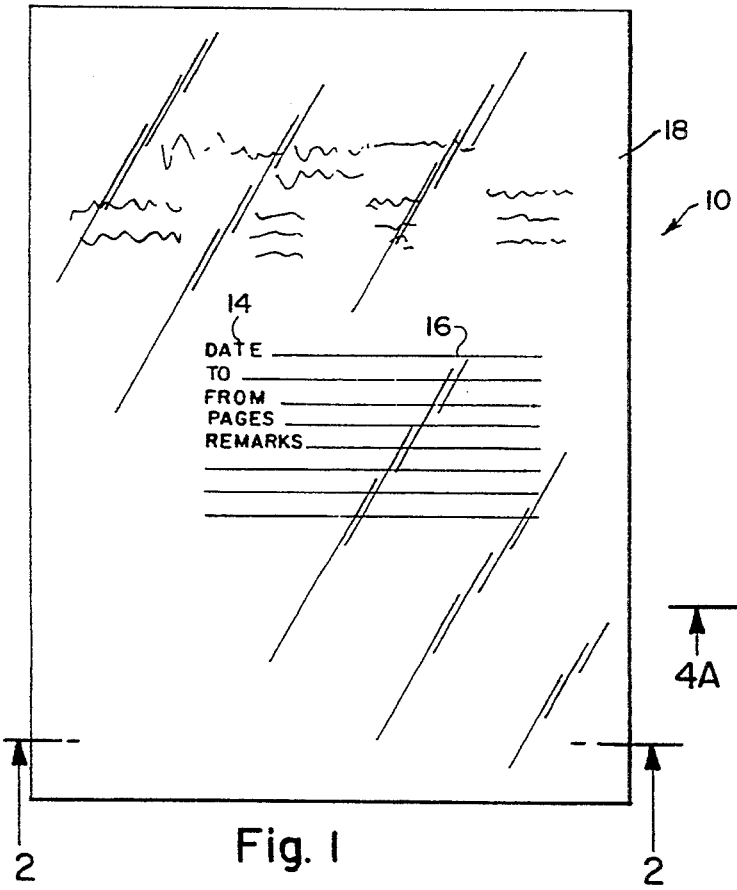
FIG. 1 is an elevational view of the reusable cover letter.
Figure 2:
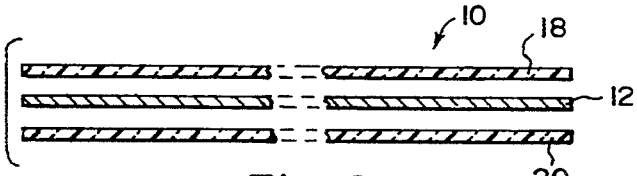
FIG. 2 is an exploded cross sectional view with parts broken away taken along line 2—2 in FIG. 1.
Figure 4A:
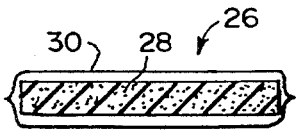
FIG. 4A is a diagrammatic cross sectional view taken along line 4A–4A in FIG. 4.

Turning now descriptively to the drawings, in which similar reference characters denote similar elements throughout the several views, FIGS. 1 and 2 illustrate a reusable facsimile cover letter 10, which consists of a paper sheet 12 printed with indicia 14 and blank lines 16 on both sides. A first layer 18 of heat sealed clear plastic laminate is on a first side of the paper sheet 12. A second layer 20 of heat sealed clear plastic laminate is on a second side of the paper sheet 12. Data can be written at the blank lines 16 on the first layer 18 and the second layer 20 to be used in a facsimile machine, then erased and replaced with new data.

Figure 3:
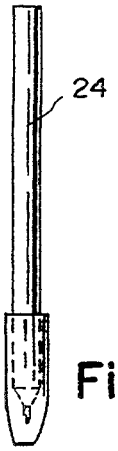
FIG. 3 is an elevational view of the marker pen.
Figure 4:
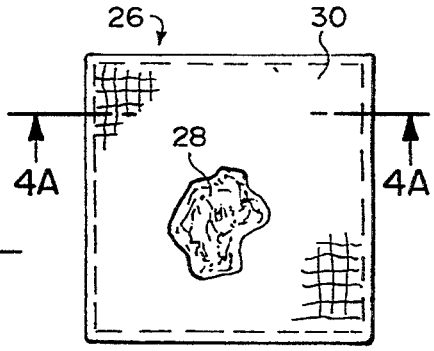
FIG. 4 is an elevational view with parts broken away of the eraser.

FIG. 3 shows a marker pen 24 for writing the data on the first layer 18 and the second layer 20 on the cover letter 10. FIG. 4 shows an eraser 26 having a sponge 28 encased in cloth covering 30, for erasing the data from the first layer 18 and the second layer 20 on the cover letter 10.

Figure 5:
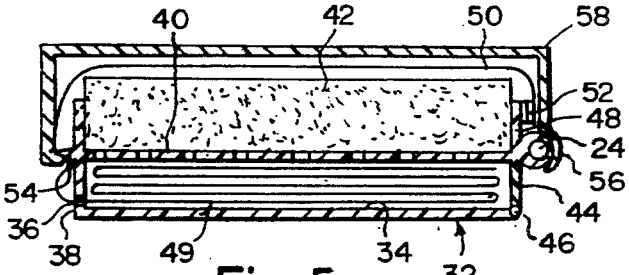
FIG. 5 is a diagrammatic cross sectional view of a modification being a container and holder for the eraser and marker pen with a cover and compartment for a storable cloth sheet to extend over the eraser, when the cover is removed.

FIG. 5 shows a container 32 having a storage compartment 34 with an exit slot 36 on a first side 38 and a perforated recessed seat 40 above and in conjunction with the storage compartment 34. A sponge 42 fits into and extends upwardly from the perforated recessed seat 40. A door 44 is hinged at 46 for closing an access opening in a second side 48 of the container 32 opposite from the first side 38, so as to permit access into the storage compartment 34. An elongate cloth strip 49 is folded within the storage compartment 34, with a leading portion 50 extending through the exit slot 36 and over the sponge 42. A component 52 is for fastening a free end of the leading portion 50 of the elongate cloth strip 49 to the second side 48 of the container 32 above the door 44. The leading portion 50 of the elongate cloth strip 49 will cover the sponge 42 and be used in erasing the data from the first layer 18 and the second layer 20 of the cover letter 10. A cutter 54 is on the first side 38 of the container 32 above the exit slot, to cut off the leading portion of the elongate cloth strip 49 after it becomes very soiled. A clip 56 is on the second side 48 of the container 32 above the door 44, for holding the marker pen 24 thereto when not in use. A removable cover 58 fits over the leading portion 50 of the elongate cloth strip 49 covering the sponge 42 and is engagable with the cutter 54 and the clip 56.

OPERATION OF THE INVENTION

To use the reusable facsimile cover letter 10, a person simply takes the marker pen 24 which can be a dry erase type or a wet erase type and fills in the data in the blank lines 16 on the first layer 18 or second layer 20. The cover letter 10 is then used in a facsimile machine. To remove the data the eraser 26 is used dry for the dry erase type marker pen 24. If a wet erase type marker pen 24 is used, the eraser 26 can be dampened with water to remove the data. The sponge 42 can also be used in the same manner as the eraser 26.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A kit for use with facsimile machines, comprising:

a reusable facsimile cover letter which includes a paper sheet printed with indicia and blank lines on both sides;

a first layer of heat sealed clear plastic laminate on a first side of said paper sheet;

a second layer of heat sealed clear plastic laminate on a second side of said paper sheet, in which data can be written at the blank lines on said first layer and said second layer to be used in a facsimile machine, then erased and replaced with new data;

a marker pen for placing data on said first layer and said second layer of said cover letter;

means for erasing data applied to said cover letter, whereby said cover letter can be reused with facsimile machines on a repetitive basis;

said erasing means comprising a sponge and a cloth strip overlying said sponge;

means for operatively positioning said sponge and cloth strip together, comprising a container having a storage compartment, and a perforated seat overlying said compartment;

said sponge being located on said perforated seat;

said cloth strip being folded within said storage compartment;

said storage compartment having an exit opening located so that a section of the cloth strip can be extended through the exit opening and over said sponge to provide a cloth covering for the sponge;

means (52) for fastening a leading edge of the cloth strip to the container, whereby the cloth covering is usable in conjunction with said sponge for erasing data that has been applied to said cover letter;

a cutter means on said container in near proximity to said exit slot, whereby the cloth covering can be severed from the folded cloth strip after said covering has become soiled; and a removable cover fittable on said container to overly said sponge and associated cloth covering.

* * * * *